United States Patent [19]

Shustack

[11] Patent Number: 4,635,929

[45] Date of Patent: Jan. 13, 1987

[54] KARATE EXERCISING BAG

[76] Inventor: Leonard T. Shustack, P.O. Box 63, Walden, N.Y. 12586

[21] Appl. No.: 738,174

[22] Filed: May 28, 1985

[51] Int. Cl.[4] ..... A63B 69/00

[52] U.S. Cl. ..... 272/76; 272/77; 272/78

[58] Field of Search ..... 272/76–78; 273/55 R, 55 B

[56] References Cited

U.S. PATENT DOCUMENTS

| | | | |
|---|---|---|---|
| 318,766 | 5/1885 | Longden | 272/76 |
| 341,231 | 5/1886 | Goodman | 272/78 |
| 426,944 | 4/1890 | Lovatt | 272/78 |
| 547,342 | 10/1895 | Foster | 272/78 |
| 835,796 | 11/1906 | Lindsley | 272/76 |
| 1,267,678 | 5/1918 | McArdle . | |
| 1,578,633 | 3/1926 | Bonde . | |
| 1,612,796 | 1/1927 | Abraham | 272/78 |
| 1,703,012 | 2/1929 | McNamara . | |
| 3,022,072 | 2/1962 | Zinnow | 272/78 |
| 3,114,549 | 12/1963 | Hooker | 273/55 R |
| 3,337,217 | 8/1967 | Cummins | 273/55 |
| 3,421,759 | 1/1969 | Chambers | 272/76 |
| 3,427,021 | 2/1969 | Donato | 273/55 R |
| 3,897,060 | 7/1975 | Jennings | 273/55 R |
| 3,927,879 | 12/1975 | Long et al. | 273/55 R X |
| 4,093,212 | 6/1978 | Jacques | 272/76 |
| 4,239,209 | 12/1980 | Curchod | 273/55 R X |
| 4,309,029 | 1/1982 | Tomko | 272/76 |
| 4,403,772 | 9/1983 | Stangle | 272/78 |

FOREIGN PATENT DOCUMENTS

| | | | |
|---|---|---|---|
| 2113601 | 9/1972 | Fed. Rep. of Germany | 272/78 |

*Primary Examiner*—Robert A. Hafer
*Assistant Examiner*—Kathleen D'Arrigo
*Attorney, Agent, or Firm*—Benoni O. Reynolds

[57] ABSTRACT

A Karate exercising bag which provides resistance to the four basic movements in that art of self defense. The exercising bag is so mounted that it responds laterally with adjustable resistance when punched or kicked by the person exercising. The exercise bag has upper and lower pole members by which the exercising bag is suspended vertically between semicircular upper and lower mounting frames. The mounting frames are interconnected and supported by two or more vertical support members. Spring-loaded swivel means is provided at the top and bottom of the pole members to provide lateral resistance to any twisting movements imparted to the exercising bag by the exerciser and to return the exercising bag to its original position when at rest. In addition, shock absorbers are mounted at right angles to the pole members to provide resistance to any rearward movement imparted to the exercising bag by the exerciser and to return the exercising bag to its original position when at rest. The preferred embodiment mounts in the corner of an exercise room. A modification could mount along any wall or be free standing.

4 Claims, 4 Drawing Figures

KARATE EXERCISING BAG

BACKGROUND OF THE INVENTION (1) Field of Invention

This invention relates to apparatus for improving athletic skills in sports. Specifically it relates to apparatus for exercising the bodily skills of the self-defense technique and sport, known as American Karate.

(2) Description of the Prior Art

Karate, the art of self-defense and sport, as practiced in the United States, was brought to these shores by the American servicemen who served in the Far East. The Professional Karate Association carries out weekly televised tournaments addressed to the large group which participates in the sport. The sport, as practiced in this country, has four basic movements, (a) the Punch, (b) the Front Drive Kick, (c) the Side Kick and (d) the Roundhouse Kick.

(a) The Punch is executed by assuming a fighting stance, moving your fist forward toward the target, and then twisting the hip while pivoting the rear foot.

(b) The Front Drive Kick is executed by raising the knee at least waist high, thrusting the ball of the foot straight at the target (stomach or groin of opponent) and recoiling back to the raised knee position.

(c) The Side Kick is executed by turning your body at right angles to the target. The knee is raised at least waist high, the heel cocked and thrust outwards to and through the target with the toes lower than the heel. The foot is then immediately recoiled to the cocked position.

(d) The Roundhouse Kick is executed by raising the knee and pointing it at the target with the lower part of the leg at a 90 degree angle to the upper part of the leg. The instep, or alternatively the ball of the foot, is swung in a slashing motion to the target (usually the middle body of the opponent).

Currently, to practice these American Karate movements, the presence of a second person is necessary to hold a padded cushion, simulating a target. These cushions are fairly thick and covered with vinyl or leather. Handles are provided on either side of the cushion to permit the assisting person to hold the cushion in various positions appropriate to the Karate movement being practiced and simulating various portions of the human body.

Various specialized equipment has been known in the prior art but most such equipment was designed for sports other than American Karate. As early as 1918, McArdle '678 invented an apparatus for boxing practice. He suspended a smaller top bag and a larger lower bag from a wall mounting, simulating the head and body of a person. Ropes and pulleys were used for adjustment and springs were interspersed in the rigging to provide resiliency. Bonde '633, in 1926, designed a free-standing novel support for striking bags which comprised a platform which was collapsible for storage and had adjustable leg members to vary the height of the platform.

In 1929, McNamara '012 invented a punching bag structure, mounted on a rockable arm which had a coil spring for resiliently holding the rocking arm upright and had a rotatable coupling to permit the bag to pivot around its vertical axis. Cummins '217, in 1967, invented a tackling dummy for conditioning football players. This dummy had a freely suspended fibrous core and was suspended by a swivel which was free generally to rotate about its vertical axis. The swivel was suspended within a coil spring to give some resiliency to the up and down movement of the dummy. Chambers '759 constructed a Judo trainer using a vertical resilient strap, suspended from the ceiling by a rope and pulley, and two divergent resilient straps which were secured to the floor. The straps were covered by a manikin to simulate a human body. The trainer was adjustable vertically by means of the rope and pulley.

The latest prior art is represented by Stangle '772 who, in 1983, designed a movable unitary structure for collectively mounting various types of exercising devices useful in the martial arts, such as a heavy bag and pads. At least five conditioning functions were supposedly provided by the structure to include a "stretch-aciser" for the arms, harness weights for the ankles, hand and elbow striking pads, and a speed bag and rebound ring for eye and hand coordination. Karate was mentioned as a covered sport.

Objectives of the prior art appear to have been portability, adjustability and compactness, with the apparatus usually customized to serve a particular sport. Other than generally conditioning arm and leg muscles, none of the prior inventions appear to fulfill all of the unique needs of American Karate in any simple manner. Prior art known to this inventor includes the following U.S. Pat. Nos.:

| | | |
|---|---|---|
| 1,267,678 | 5/1918 | McArdle |
| 1,578,633 | 3/1926 | Bonde |
| 1,703,012 | 2/1929 | McNamara |
| 3,337,217 | 8/1967 | Cummins |
| 3,421,759 | 9/1983 | Stangle |

BRIEF SUMMARY OF THE INVENTION

The present invention is a Karate Exercising Bag which is designed to meet the resiliency requirements for training in American Karate. Conventional exercise equipment now available is unsatisfactory for such training because it is too static and unadjustable to meet the sophisticated resistance needs of the four basic punches and kicks used in performing the sport. The present invention meets these needs by being adjustable, portable and installable in a permanent or free standing mode.

According to the preferred embodiment of this invention, an exercising bag, having an upper pole member and a lower pole member, is suspended vertically by support means. This support means is a top mounting frame and a bottom mounting frame which are mounted parallel with one another, interconnected and supported by three or more adjustable vertical support members. The top mounting frame and the bottom mounting frame are semi-circular bars fastened at each end to a pair of mounting straps which enclose a 90 degree angle. This shape permits the Karate Exercising Bag to be easily installed in a corner of a room either fastened to the walls as a permanent fixture or left free standing for temporary use.

The Karate Exercising Bag has swivel means for providing resistance to any twisting movement imparted to the exercising bag by an exerciser. Swivel means is spring-loaded swivels attaching the upper pole member to the top mounting frame and attaching the lower pole member to the bottom mounting frame. These swivels offer not only resistance to the twisting movements of the exercising bag to the left or right but also cause the exercising bag to return immediately to its original central position after it is so twisted.

The Karate Exercising Bag has resistance means for providing adjustable resistance to the rearward movement imparted to the exercising bag by an exerciser. This resistance means is adjustable shock absorbers, mounted at right angles to, and interconnected to, the upper pole member and to the lower pole member. These adjustable shock absorbers permit the exercising bag, when struck head on from the front by an exerciser, to give way rearward with a resiliency determined by the adjustment of the shock absorbers set in by the exerciser. The shock absorbers also cause the exercising bag to return forward to its original position after the force imparted by the exerciser is removed. Guide rails are provided in the top mounting frame and in the bottom mounting frame to restrict the rearward movement of the exercising bag to one plane. These guide rails are mounted at right angles to the upper pole member and to the lower pole member, extending from the center of each of the semi-circular bars to the intersection of each pair of mounting straps. This position keeps the bag at the optimum distance from each of the adjustable vertical support rods and centered in the apparatus for the safety and convenience of the exerciser.

When struck or kicked headon, the exercising bag recedes rearward according to the resiliency set into the adjustable shock absorbers by the exerciser and then returns forward to its original position when the force imparted by an exerciser is removed. Likewise, when struck or kicked in a slashing movement by the exerciser, the exercising bag twists either right or left with the resiliency offered by the spring-loaded swivel which swivel also returns the exercising bag to its original central position when the force imparted by an exerciser ceases.

OBJECTIVES OF THE INVENTION

The objectives of the present invention are to provide a Karate Exercising Bag for use in homes, spas or gymnasiums, which:

(1) permits use without the assistance of other persons;

(2) develops balance, accuracy, power and coordination;

(3) exercises the arms, upper back, shoulder muscles, thighs and legs;

(4) offers resilient resistance to each of the four basic movements of American Karate which closely simulates the resistance and reaction of a live opponent;

(5) offers resiliency which is fully adjustable to the size, strength and other needs of the individual exerciser;

(6) is safe for the novice exerciser to use;

(7) can be installed either as a free-standing unit or as a permanent fixture;

(8) has an adjustable structure for various height ceilings;

(9) can be easily disassembled for portability.

DETAILED DESCRIPTION OF THE PREFERRED EMBODIMENT OF THE INVENTION

Figure 1:
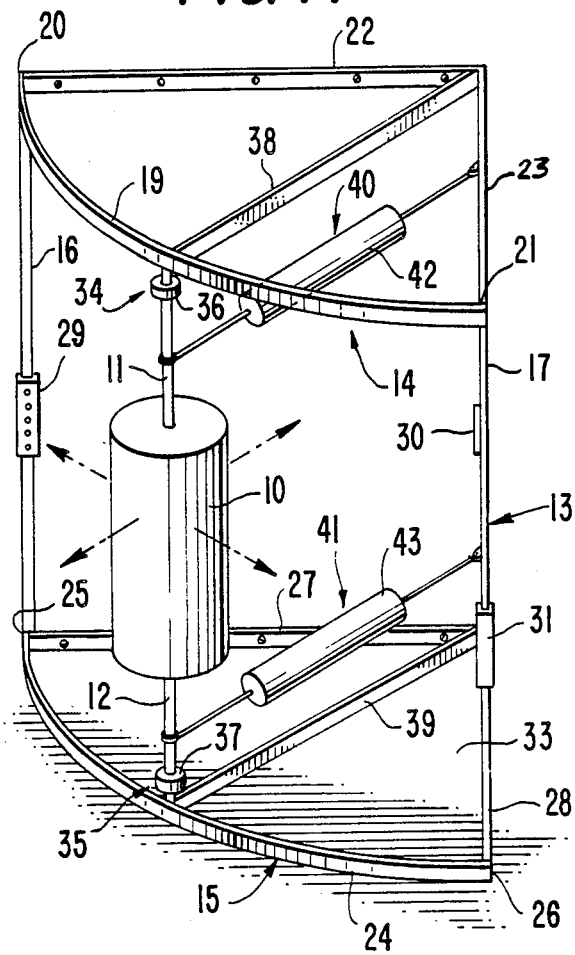
FIG. 1 is a perspective view from the right front of a Karate Exercising Bag constructed in accordance with the principles of the present invention, showing the suspended exercising bag, its upper and lower pole members, the spring-loaded swivels, the adjustable shock absorbers, the top and bottom mounting frames, with their guide rails, and the adjustable vertical support members.

The Karate Exercising Bag is a self-contained unit which is easily and quickly installed either as a free-standing exercising unit in a home or as a permanent structure in a professional gymnasium. Throughout the following detailed description of the present invention, like reference numerals are used to denote like parts disclosed in the accompanying drawings, FIGS. 1–4.

Figure 2:
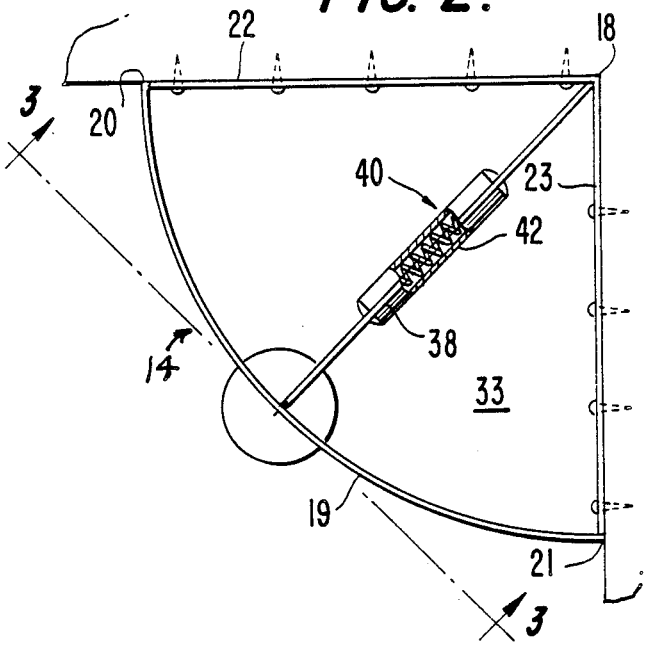
FIG. 2 is a plan view of the same present invention showing the top mounting frame and its semi-circular bar, guide rail and mounting straps.
Figure 4:
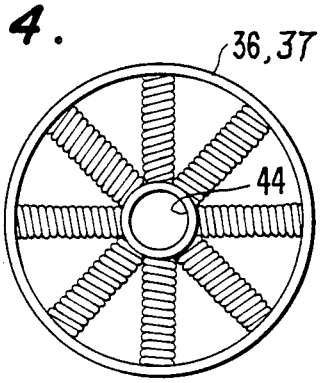
FIG. 4 is an enlarged cross-sectional plan view of the spring-loaded swivel of the present invention.
Figure 3:
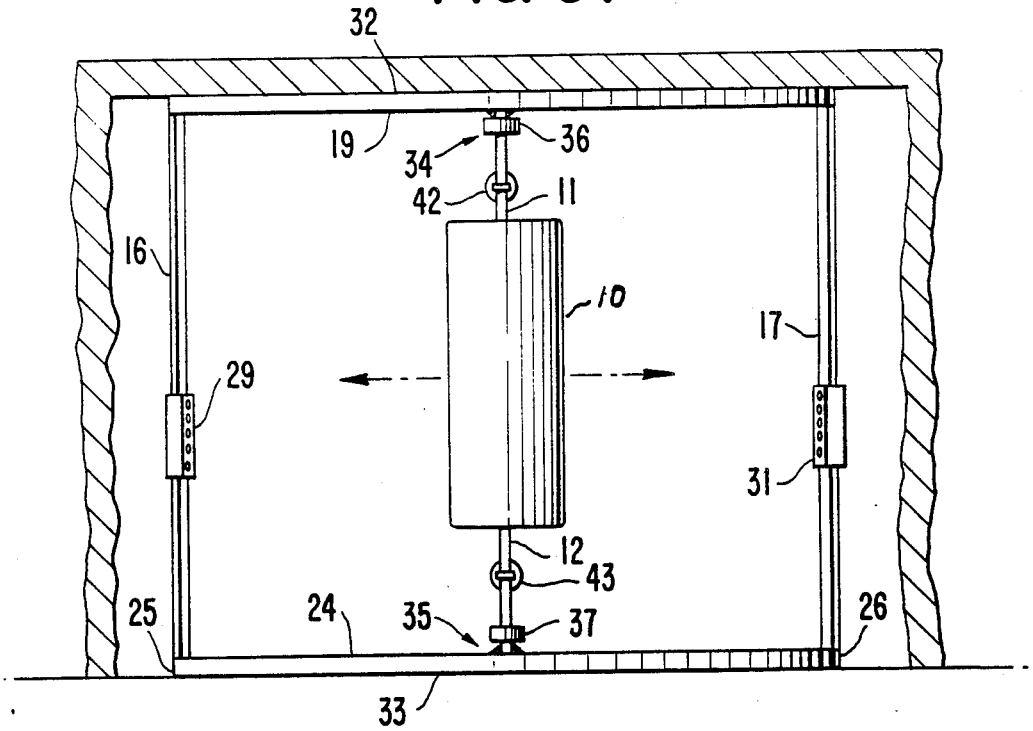
FIG. 3 is a view taken along line 3—3 of FIG. 2, showing the top and bottom semi-circular bars, the adjustable vertical support members, the exercising bag with its upper and lower pole members, and the spring-loaded swivels which secure the exercising bag to the top and bottom mounting frames.

As shown in FIG. 1, the preferred embodiment of the present invention comprises an exercising bag 10, having an upper pole member 11 and a lower pole member 12, suspended vertically by support means, shown generally at reference 13. Support means 13 is top mounting frame, shown generally at reference number 14, and bottom mounting frame, shown generally at reference number 15, which mounting frames are mounted parallel to one another, interconnected by three or more adjustable vertical support members 16, 17 and 18. As best shown in FIG. 2, top mounting frame 14 is semi-circular bar 19 fastened at ends 20 and 21 to a pair of mounting straps 22 and 23, which mounting straps enclose a 90 degree angle. As best shown in FIG. 1, bottom mounting frame 15 is semicircular bar 24 fastened at ends 25 and 26 to a pair of mounting straps 27 and 28, which mounting straps enclose a 90 degree angle. The shape of top mounting frame 14 and bottom mounting frame 15 permits the Karate Exercising Bag to be easily installed in a corner of a room, either fastened to the walls as a permanent structure or left free-standing for temporary use. Vertical support members 16, 17 and 18 have adjustable couplings 29, 30 and 31 to permit top mounting frame 14 to be raised to touch ceiling 32 while bottom mounting frame 15 rests upon floor 33.

At the top, exercising bag 10 is attached to semi-circular bar 19 by swivel means, shown generally at reference numeral 34. Similarly, at the bottom, exercising bag 10 is attached to semi-circular bar 24 by swivel means, shown generally at reference numeral 35. Swivel means 34 and swivel means 35 provide resistance to any twisting movement imparted to exercising bag 10 by an exerciser. Swivel means 34 is a spring-loaded swivel 36, having a plurality of tightly coiled springs 44, attached to upper pole member 11 which swivel returns exercising bag 10 rotationally to its original centered position after exercising bag 10 is struck a slashing blow by the exerciser, either from the right or the left. Swivel means 35 is a spring-loaded swivel 37, having a plurality of tightly coiled springs 44, attached to lower pole member 12 which swivel returns exercising bag 10 rotationally to its original centered position after exercising bag 10 is struck a slashing blow by the exerciser, either from the right or the left.

Spring-loaded swivel 36 is slidably engaged within guide rail 38, of top mounting frame 14, to restrict the rearward movement of exercising bag 10 to one plane. Guide rail 38 is mounted at right angles to upper pole member 11, extending rearwardly from the center of semi-circular bar 19 to the intersection of mounting straps 22 and 23. Similarly, spring-loaded swivel 37 is slidably engaged within guide rail 39, of bottom mounting frame 15, to restrict the rearward movement of exercising bag 10 to one plane. Guide rail 39 is mounted at right angles to lower pole member 12, extending rearwardly from the center of semi-circular bar 24 to the intersection of mounting straps 27 and 28. Guide rail 38 and guide rail 39 also serve to keep exercising bag 10 at an optimum distance from adjustable vertical supports 16, 17 and 18, and centered in support means 13, for the safety and convenience of the exerciser.

Resistance means, shown generally at reference numerals 40 and 41, provide adjustable resistance to rearward movement imparted to exercising bag 10 by an exerciser. Resistance means 40 is adjustable shock absorber 42, mounted at right angles to, and interconnected to, upper pole member 11 and vertical support member 18. Similarly, resistance means 41 is adjustable shock absorber 43, mounted at right angles to, and interconnected to, lower pole member 12 and vertical support member 18. Adjustable shock absorber 42 and adjustable shock absorber 43 are each adjustable to offer the resistance desired by the individual exerciser.

When struck or kicked headon, exercising bag 10 recedes rearwardly within guide rails 38 and 39 according to the resiliency set into adjustable shock absorbers 42 and 43 by the exerciser. Then exercising bag 10 is returned forward by adjustable shock absorbers 42 and 43, when the force imparted by the exerciser is removed. Likewise, when struck or kicked in a slashing movement by the exerciser, exercising bag 10 twists rotationally, either clockwise or counterclockwise, with the resiliency offered by spring-loaded swivels 36 and 37. Spring-loaded swivels 36 and 37 also return exercising bag 10 to its original centered position when the force imparted by the exerciser ceases.

I claim:

1. Apparatus for providing controlled resistance to the movements of Karate comprising:

an exercising bag, for striking or kicking by an exerciser, said exercising bag having an upper pole member and a lower pole member, and a top mounting frame and a bottom mounting frame, mounted parallel to one another, interconnected and supported by three or more adjustable vertical support members, for vertically supporting said exercising bag, and adjustable shock absorbers, mounted at right angles to, and interconnected to, said upper pole member and said lower pole member, for providing adjustable resistance to rearward movement imparted to said exercising bag by an exerciser, and spring-loaded swivels attaching said upper pole member to said top mounting frame and attaching said lower pole member to said bottom mounting frame, for providing resistance to any twisting movement imparted to said exercising bag by an exerciser.

2. The apparatus of claim 1 wherein said top mounting frame and said bottom mounting frame are semi-circular bars fastened at each end to mounting straps which enclose a 90 degree angle.

3. The apparatus of claim 2 wherein guide rails are provided in said top mounting frame and in said bottom mounting frame, to restrict the rearward movement of said exercising bag to one plane.

4. The apparatus of claim 3 wherein said guide rails are mounted at right angles to said upper pole member and to said lower pole member, extending rearward from the center of each of said semi-circular bars to the intersection of each pair of said mounting straps.

* * * * *